US005966840A

United States Patent [19]

Bell et al.

[11] Patent Number: 5,966,840

[45] Date of Patent: Oct. 19, 1999

[54] TRACTION ALTERING FOOTWEAR ATTACHMENT DEVICE WITH RESILIENT MOUNTING RING AND FIBER GROUND ENGAGEMENT SURFACE

[75] Inventors: Michael Bell, 756 Rydal Green Dr., Rydal, Pa. 19046; Jonathan Marc Bell, Maple Glen; Eric P. Bell, Philadelphia, both of Pa.

[73] Assignee: Michael Bell, Rydal, Pa.

[21] Appl. No.: 09/033,573

[22] Filed: Mar. 3, 1998

Related U.S. Application Data

[63] Continuation-in-part of application No. 09/012,108, Jan. 22, 1998.

[51] Int. Cl.[6] ..... A43B 3/10

[52] U.S. Cl. ..... 36/7.6; 36/7.5; 36/7.1 R

[58] Field of Search ..... 36/7.6, 7.1 R, 36/59 R, 7.5

[56] References Cited

U.S. PATENT DOCUMENTS

| | | | |
|---|---|---|---|
| 1,032,600 | 7/1912 | Grout . | |
| 1,716,790 | 6/1929 | Mitchell . | |
| 1,747,603 | 2/1930 | Ruth . | |
| 1,877,080 | 9/1932 | Teshima . | |
| 2,076,316 | 4/1937 | Beals, Jr. . | |
| 2,189,489 | 2/1940 | Fritz | 36/7.6 |
| 2,361,972 | 11/1944 | Smith . | |
| 2,408,152 | 9/1946 | Porcelli . | |
| 2,617,209 | 11/1952 | Jackson . | |
| 2,628,437 | 2/1953 | Forsythe . | |
| 2,801,478 | 8/1957 | Gilbert . | |
| 3,012,343 | 12/1961 | Dinkel . | |
| 3,040,451 | 6/1962 | Hilkemeyer . | |
| 3,099,885 | 8/1963 | Jordan et al. | 36/59 R |
| 3,214,850 | 11/1965 | McNair . | |
| 3,229,389 | 1/1966 | Adams . | |
| 3,355,823 | 12/1967 | Vogt | 36/7.6 |
| 3,516,181 | 6/1970 | Jordan . | |
| 3,609,888 | 10/1971 | Rickman . | |
| 4,217,704 | 8/1980 | Whitaker | 36/59 R |
| 4,302,890 | 12/1981 | Covell et al. . | |
| 4,344,238 | 8/1982 | Peyser . | |
| 4,353,172 | 10/1982 | Bryant . | |
| 4,489,510 | 12/1984 | Williams | 36/7.6 |
| 4,525,939 | 7/1985 | McNeil et al. . | |
| 4,727,662 | 3/1988 | Ilon . | |
| 4,807,372 | 2/1989 | McCall . | |
| 4,910,883 | 3/1990 | Zock, Jr. . | |
| 4,924,608 | 5/1990 | Mogonye . | |
| 5,341,582 | 8/1994 | Liautaud . | |
| 5,485,687 | 1/1996 | Rohde . | |

OTHER PUBLICATIONS

"Easy–Wear Ice Cleats" sold by Carole Martin Gifts of Champlain NY.

"Spiky Slip Protection On Ice And Snow" sold by G.W.Russell & Associates, Ltd. of Allentown, PA.

"Rud Shoe Chain" sold by RUD–Kettenfabrik Rieger & Dietz of Germany.

A catalog page showing a "68 300 . . . Spiky plus," a "C/68 301 . . . Conti–Spiky," and a "A/68 310 00 Rud Quickstep" non–slip footwear attachments.

*Primary Examiner*—M. D. Patterson

*Attorney, Agent, or Firm*—Caesar, Rivise, Bernstein, Cohen & Pokotilow, Ltd.

[57] ABSTRACT

A footwear attachment device for releasable mounting on primary footwear, e.g., a boot or shoe, to provide enhanced traction. The primary footwear has an upper including a toe portion and a heel portion, a sole including a fore-foot portion and a heel portion. The attachment device comprising an integral member having a mounting ring, a forefoot-sole engaging portion, a heel-sole engaging portion, and plural connecting webs. The attachment device is preferably molded of a resilient material. The forefoot-sole engaging portion and the heel-sole engaging portion of the device are each a generally planar member mounted within the bounds of the ring by the connecting webs. The ring is stretchable to enable it to encircle the upper of the primary footwear to releasably mount it, so that its forefoot-sole engaging portion is engagement with the forefoot portion of the sole of the primary footwear, and its heel-sole engaging portion is in engagement with the heel portion of that sole. The forefoot-sole portion and the heel-sole portion of the attachment device each have a ground engaging surface, e.g., a multitude of organized or disorganized fibers, plural ridges, grooves, cleats or combinations thereof, for providing a desired type of traction. A pull tab is also provided on the ring to facilitate the mounting of the ring on the primary footwear. A disposable gritted pad having a pressure-sensitive adhesive is provided for releasable mounting on the ground engaging surface of the attachment device or on the sole of the primary footwear to enhance the traction provided thereby.

9 Claims, 7 Drawing Sheets

TRACTION ALTERING FOOTWEAR ATTACHMENT DEVICE WITH RESILIENT MOUNTING RING AND FIBER GROUND ENGAGEMENT SURFACE

RELATED APPLICATION

This application is a Continuation-In-Part of our earlier application Ser. No. 09/012,108, filed on Jan. 22, 1998, entitled Traction Altering Attachment Device With Resilient Mounting Ring For Use On Footwear, which application is assigned to the same assignee as this invention and whose disclosure is incorporated by reference herein.

BACKGROUND OF THE INVENTION

This application relates generally to footwear and more particularly to attachments which are adapted to be stretched over a portion of the upper of an article of primary footwear, e.g., a shoe or boot, so that a portion of it is on the sole/heel of primary the primary footwear to alter the amount of ground engaging traction provided thereby, e.g., to enhance the traction to provide increased resistance to slippage.

Various ice gripping, sandal-like, attachments for footwear are commercially and have been disclosed in the patent literature. Examples of such patented devices are found in the following U.S. Pat. No. 1,032,600 (Grout); U.S. Pat. No. 2,361,972 (Smith); U.S. Pat. No. 3,214,850 (McNair); U.S. Pat. No. 3,516,181 (Jordan); U.S. Pat. No. 4,344,238 (Peyser); U.S. Pat. No. 4,353,172 (Bryant); U.S. Pat. No. 4,525,939 (McNeil et al.); and U.S. Pat. No. 4,910,883 (Zock, Jr.).

There are also some spike or cleat-bearing attachments which are commercially available for use on footwear to prevent slippage on ice or other slippery surfaces. One such type of attachment is sold under the trademark "RUD Shoe Chain" and is a rubber ring having chains extending between opposed portions of the ring. The rubber ring is arranged to be stretched over the upper of a boot or shoe so that the chains extend under the sole and heel to provide traction on ice and snow.

Another type of attachment is sold under the trademark SPIKY and is in the form of a resilient rubber sling or overshoe having plural metal spikes or cleats on the bottom thereof and which are arranged to dig into ice when the attachment is worn over an article of primary footwear, e.g., a boot or shoe.

While the aforementioned prior art devices are generally suitable for their intended purposes, they still leave something to be desired from various standpoints, such as simplicity of construction, compactness, ease of mounting and removing, integrity of components and effectiveness.

Other prior art attachment devices for footwear are shown in the following U.S. Pat. No. 1,716,790 (Mitchell), U.S. Pat. No. 1,747,603 (Ruth), U.S. Pat. No. 1,877,080 (Teshima), U.S. Pat. No. 2,076,316 (Beals, Jr.), U.S. Pat. No. 2,617,209 (Jackson), U.S. Pat. No. 2,628,437 (Forsythe), U.S. Pat. No. 3,012,343 (Dinkel), U.S. Pat. No. 3,040,451 (Helkemeyer), U.S. Pat. No. 3,609,888 (Rickman), U.S. Pat. No. 4,807,372 (McCall), U.S. Pat. No. 4,302,890 (Covell et al.), U.S. Pat. No. 4,727,662 (Ilon), U.S. Pat. No. 4,924,608 (Mongonye), U.S. Pat. No. 5,485,687 (Rohde), and U.S. Pat. No. 5,341,582 (Liautand).

OBJECTS OF THE INVENTION

Accordingly, it is a general object of this invention to provide an attachment device for use on primary footwear, e.g., a boot, shoe, etc., which overcomes the disadvantages of the prior art.

It is another object of this invention to provide an attachment device for primary footwear including a ground engaging portion and a resilient mounting ring to enable the device to be releasably mounted on the primary footwear.

It is another object of this invention to provide an attachment device for primary footwear including a ground engaging portion and a resilient mounting ring for releasably mounting the device on the primary footwear and when so mounted is resistant to accidental dismounting.

It is another object of this invention to provide an attachment device for primary footwear which is arranged to be easily mounted on the primary footwear and easily removed therefrom, yet is resistant to accidental dismounting.

It is another object of this invention to provide an attachment device for primary footwear which includes a ground engaging portion to provide some desired type of engagement with the ground not provided by the primary footwear, such as general slip resistance, specific (e.g., lateral) slip resistance, low friction, etc.

It is yet another object of this invention to provide an attachment device for primary footwear which is simple in construction.

It is yet another object of this invention to provide an attachment device for primary footwear which can be readily manufactured.

It is yet another object of this invention to provide an attachment device for primary footwear which can be molded as a one-piece unit.

It is yet another object of this invention to provide an attachment device for primary footwear which when not in use assumes a flat, compact state but which can be rolled up, if desired.

It is yet another object of this invention to provide an attachment device for primary footwear which includes a ground engaging portion upon which disposable friction-enhancing pads can be releasably secured to provide resistance to slippage on slippery surfaces.

SUMMARY OF THE INVENTION

These and other objects of the subject invention are achieved by providing a footwear attachment device for releasable mounting on an article of footwear (primary footwear) to provide a desired type of traction, the primary footwear has an upper including a toe portion and a heel portion, a sole including a fore-foot portion and a heel portion. The attachment device comprising an integral member having a mounting ring, a forefoot-sole engaging portion, and a heel-sole engaging portion. The forefoot-sole engaging portion si mounted within the bounds of the ring and has an ground engaging surface formed of fibers, e.g., organized or disorganized synthetic fibers. The heel-sole engaging portion is also mounted within the bounds of the ring and has a ground engaging surface also formed of fibers, e.g., organized or disorganized synthetic fibers.

The ring is stretchable to enable it to encircle the upper of the primary footwear to releasably mount the attachment device on that footwear, with the forefoot-sole engaging portion being disposed in engagement with the forefoot portion of the sole of the primary footwear, and with the heel-sole engaging portion being disposed in engagement with the heel portion of the sole of the primary footwear. When so mounted the ground engaging fibers are exposed for providing a desired type of traction.

DESCRIPTION OF THE DRAWING

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENTS

Figure 1:
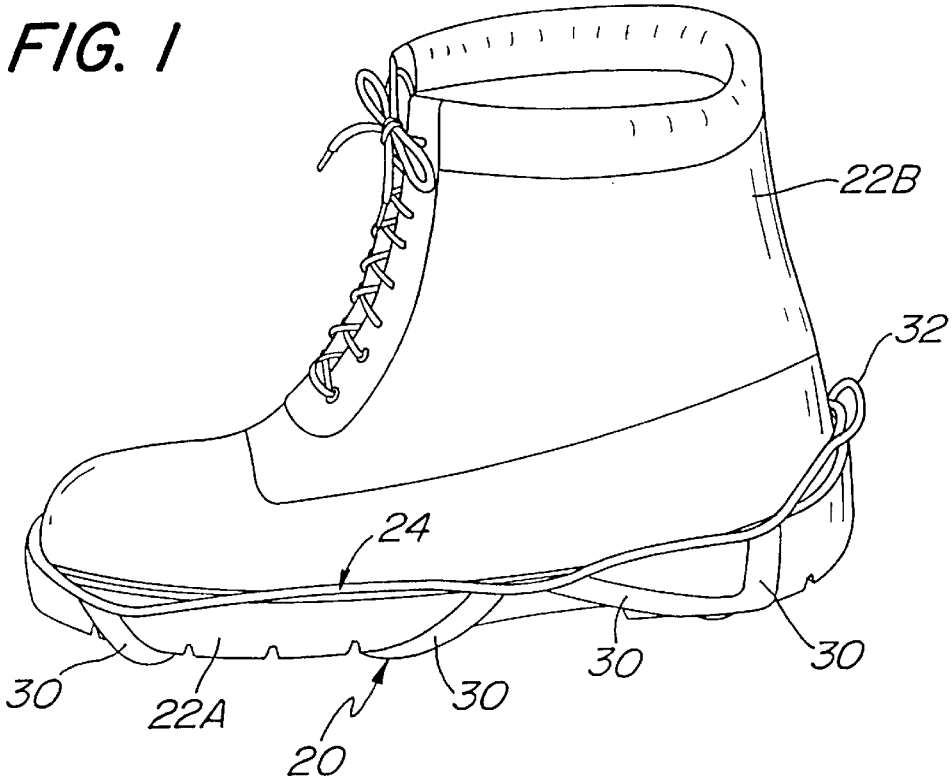
FIG. 1 is an isometric view of one embodiment of the attachment device of the subject invention shown in use mounted on a conventional primary footwear, e.g., a boot, to provide enhance traction.
Figure 9:
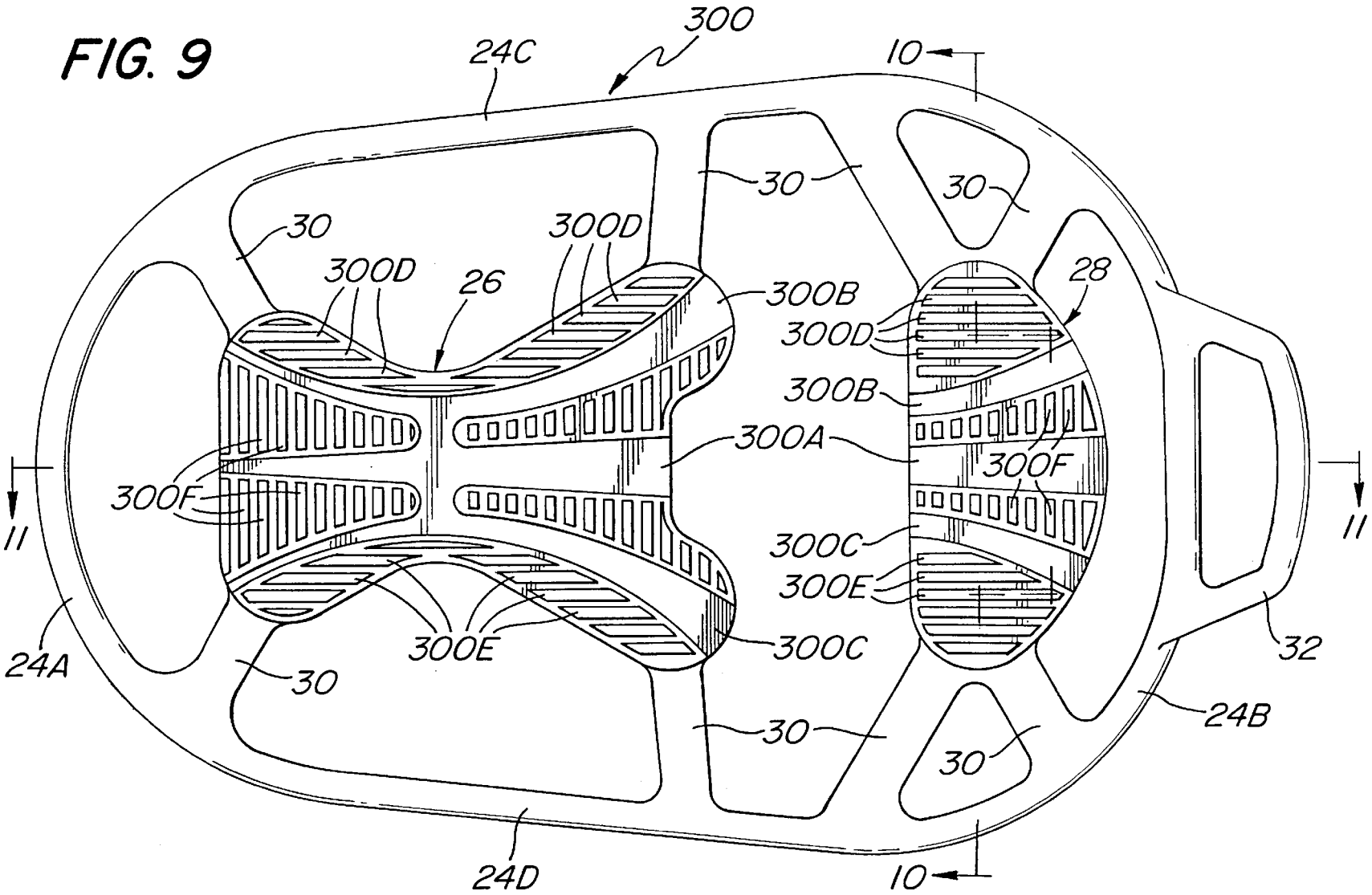
FIG. 9 is a plan view of another alternative embodiment of the attachment device of this invention, the attachment device including recesses or grooves to enhance traction in wet or sloppy conditions.
Figure 10:
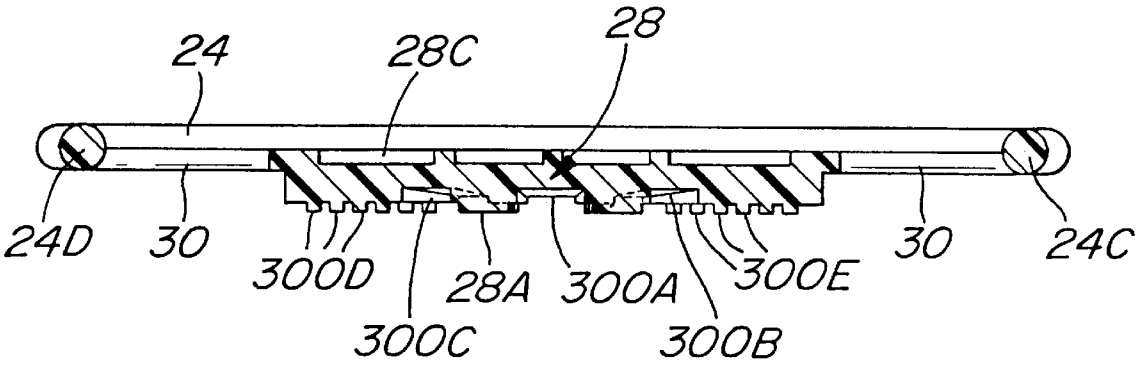
FIG. 10 is a sectional view taken along line 10—10 of FIG. 9.
Figure 11:
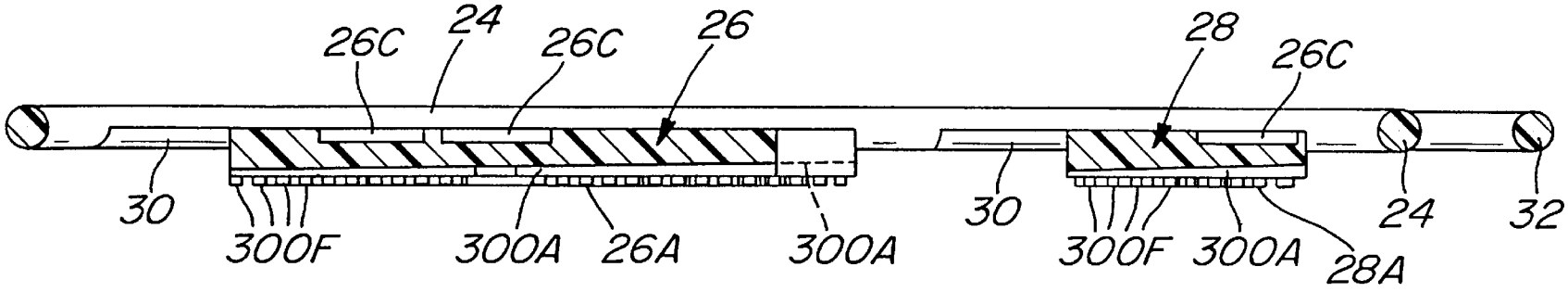
FIG. 11 is an enlarged sectional view taken along line 11—11 of FIG. 9.

Referring now to various figures of the drawing where like reference numerals refer to like parts there is shown at 20 in FIG. 1, a footwear attachment device constructed in accordance with this invention for securement to any type of conventional footwear 22, e.g., a boot, having a sole 22A and an upper 22B, to render the it resistant to slippage on slippery surfaces. The embodiments of the attachments shown in FIGS. 3–6 are suitable for enhancing traction on all but the slipperiest conditions, e.g., smooth ice. For those severe slippery conditions, the attachment devices of this invention preferably include plural cleats including ice-piercing spikes, such as those in the embodiments of FIGS. 6, 7, and 13. The embodiment of the attachment device shown in FIGS. 9–11 is particularly suited for providing slip resistance on wet surfaces and/or artificial sports surfaces. In some applications, it may be desired to provide a different level of enhanced traction than would otherwise be provided by the attachment device itself. Thus, for these applications at least one optional friction-enhancing pad may be releasably secured to portions of the ground engaging surfaces of the attachment device.

It must be pointed out at this juncture that the subject invention is not limited to footwear attachment devices for enhancing traction. Thus, footwear attachment devices contemplated by this invention can be configured to decrease traction, rather than increase it. Such traction reduction may be desirable for various applications. For example, a traction reducing footwear attachment device in accordance with this invention may be provided to mount onto a conventional shoe to convert it to one suitable for use in bowling.

Figure 2:
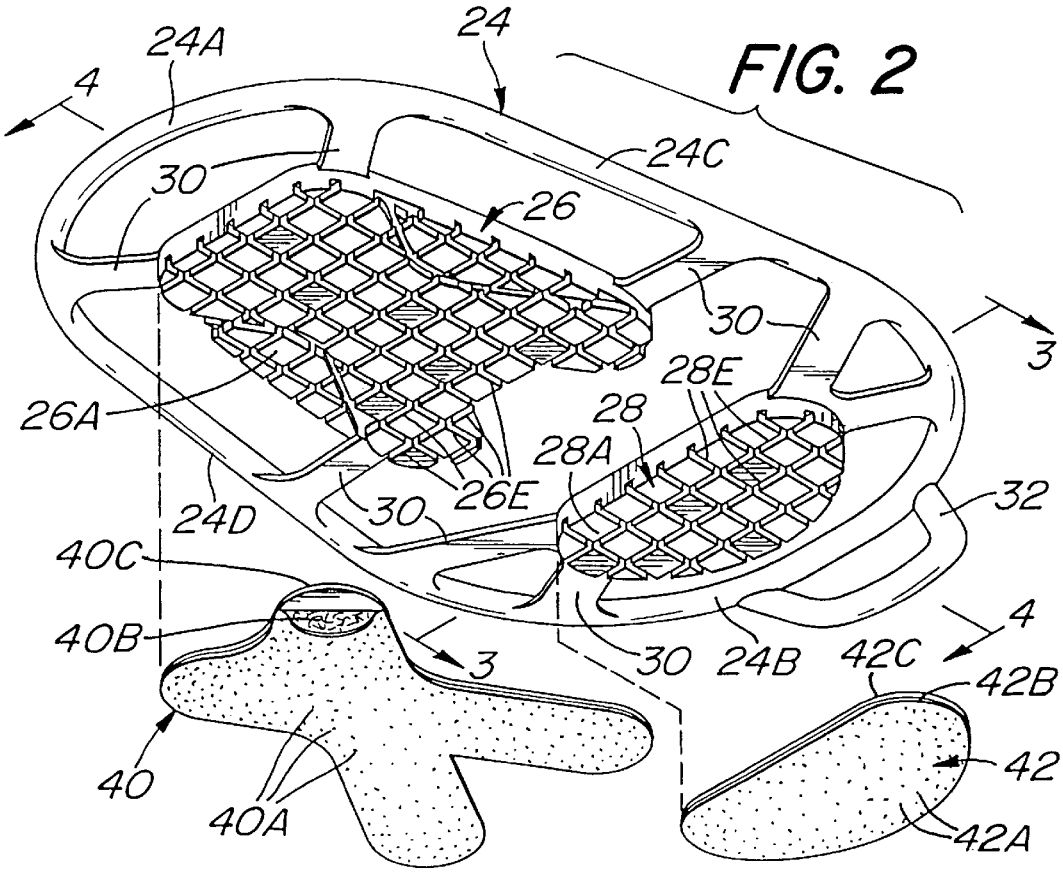
FIG. 2 is an enlarged exploded isometric view of the embodiment of the attachment device of FIG. 1 shown in its compact, generally flat state prior to mounting on the footwear, this view also showing a pair of optional traction enhancing pads arranged for releasable securement to the attachment device.

As will be described in detail later each embodiment of the attachment devices of this invention is preferably formed (e.g., molded) as a one-piece or unitary member of a flexible and resilient material, e.g., rubber, PVC, TPR etc., in the interests of manufacturing simplicity and economy. Moreover, each attachment device is constructed so that it normally assumes a generally flat, compact configuration when not in use in the interest of ease of storage and/or transportation, but can be readily stretched into a non-planar shape for mounting onto the article of primary footwear on which it is to be worn. To that end, as can be seen in FIG. 2 the attachment device 20 basically comprises a generally planar member comprising a mounting ring portion 24, a forefoot-sole portion or pad 26, a heel-sole portion or pad 28, and plural connecting webs 30, all molded as an integral or one-piece member. In accordance with one preferred aspect of the invention the device 20 also includes an integral pull-tab 32.

The ring 24 is an annular member of a generally flattened oval shape, having an arcuate front or toe section 24A, an arcuate rear or heel section 24B, and two generally linear side sections 24C and 24D interconnecting the ends of the toe and heel sections 24A and 24B, respectively. The cross section of the ring portion 24 is circular (See FIGS. 3 and 4). In one preferred embodiment the length of the ring, i.e., the distance between the forwardmost portion of the toe section 24A and the rear most portion of the heel section 24B is approximately 10 inches (25.4 cm.), the width of the ring between the side sections 24C and 24D at the point where they merge with the arcuate toe section 24A is approximately 5 inches (12.7 cm.), and the width of the ring between those sections where they merge with the arcuate heel section 24B is approximately 6 inches (15.2 cm). These dimensions, coupled with the fact that the material forming the ring is resilient, enables the ring 24 to be readily stretchable to accommodate various common sizes of primary footwear 22.

The thinness of the connecting webs 30 enables them to stretch readily with the ring 24 to facilitate the mounting and dismounting of the attachment device 20 onto various sizes of primary footwear. The pads, in contradistinction, are preferably sufficiently thick to provide resistance to stretching and stability to the device. In addition the thickness of the pads provides additional cushioning and/or shock absorption over that provided by the primary footwear.

The forefoot-sole portion or pad 26 is a generally planar member of irregular, but longitudinally symmetrical shape. The pad 26 includes an outer, ground engaging surface 26A, and an inner surface 26B. In accordance with one preferred aspect of this invention the thickness of the pad 26, i.e., the distance between its inner and outer surfaces, is at least equal to and preferably slightly greater than the diameter of the cross section of the ring 24. In the interests of weight reduction plural cavities or pockets 26C (FIG. 4) are molded in the upper surface 26B of the pad 26. The forefoot-sole pad 26 is located within the ring 24 in the area bounded by the front section 24A and the contiguous side sections 24C and 24D and is held in place in that position at the front by two connecting webs 30. The pad 26 is held in this position at the rear by another two connecting pads. Each of the webs 30 is an elongated linear strip which is of significantly lesser thickness than the diameter of the cross sectional area of the ring 24 and the thickness of the forefoot-sole portion 26 to enable the connecting webs to stretch and flex readily (as is important in order to mount and hold the device in proper place on the primary footwear). For example, the diameter of the cross section of the ring is approximately 0.25 inch (6.35 mm), the thickness of each web is approximately 0.125 inch (3.2 mm), and the thickness of the pad 26 is approximately 0.32 inch (8 mm). The heel-sole pad 28 is also a generally planar member of approximately semi-circular shape and of the same thickness as the forefoot-sole pad 26. The heel-sole pad 28 also includes a ground engaging outer surface 28A and an inner surface 28B having pockets 28C, and is mounted within the ring 24 in the area bounded by the rear section 24B and the contiguous side sections 24C and 24D by the remainder of the connecting webs 30 in the same manner as the forefoot-sole portion 26 is mounted to the ring. The thickness of the pad 28 is the same as the pad 26.

As shown in FIG. 1 the mounting ring 24 of the device 20 is arranged to be stretched to encircle the upper of the primary footwear with the heel section 24B of the ring engaging the heel counter of the primary footwear, while the toe section 24A of the ring engages the upper at the toe portion of the upper. The side sections 24C and 24D extend along the sides of the upper in the upper's arch and contiguous regions. The pull tab 32 is provided to aid in pulling the ring onto the primary footwear upper, and when the device 20 is in place like shown in FIG. 1 the tab extends upward behind the primary footwear heel counter.

The ground engaging surfaces 26A and 26B of the device 20 may be constructed so that they are identical or different, depending upon the desired application for the attachment. Moreover, those surfaces may be of any desired type to provide whatever type of traction is desired. For example, if it is desired that the attachment device be utilized for general slippery conditions the surfaces 26 and 28 may include plural intersecting grooves 26E and 28E, respectively, to define a large number of square, e.g., 0.375 inch (9.5 mm), ridges therebetween. The grooves/ridges provide good traction on all but the iciest conditions. For such icy conditions, the ground engaging surfaces 26A and 26B preferably include ice-penetrating spikes, as will be described later with reference to the embodiments of FIGS. 7, 8, and 13.

Figure 3:
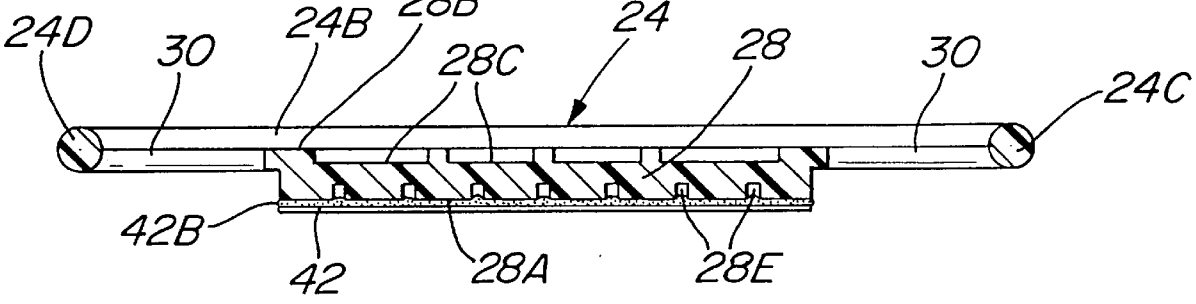
FIG. 3 is an enlarged sectional view taken along line 3—3 of FIG. 2.
Figure 4:
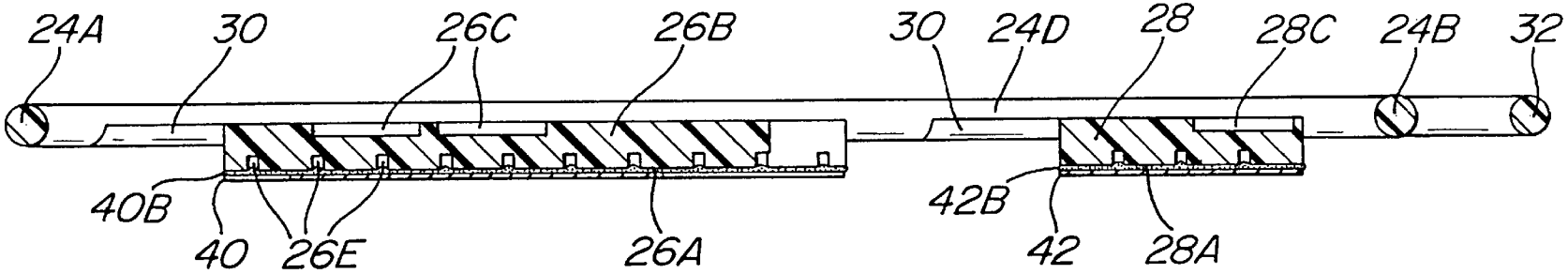
FIG. 4 is an enlarged sectional view taken along line 4—4 of FIG. 2 and showing the optional traction enhancing pads releasably secured to the attachment device.

If it is desired to provide resistance to slippage on wet and/or slushy surfaces, the ground engaging surfaces 26A and 26B may include various flared grooves as will be described later with reference to FIGS. 9–11. If it is desired to provide general slip resistance, while also providing water resistance to the article of primary footwear, the attachment device may also include a thin barrier wall between the connecting webs and pads, as will be described later with reference to FIGS. 5 and 6. If even more slip resistance is desired than that provided by the ground-engaging portions of the attachment devices of FIGS. 1–6 and 9–13, one or more optional friction-enhancing pads may be provided for releasable securement on the ground engaging pads of the attachment devices as shown in FIGS. 2–4. Each of these optional friction-enhancing pads is preferably constructed in accordance with the teachings of copending U.S. patent application Ser. No. 09/018,810, filed on Feb. 4, 1998, entitled Traction-Enhancing Gritted Pads For Adhesive Releasable Securement On Footwear, and whose disclosure is incorporated by reference herein, and which is assigned to the same assignee as this invention.

In the interest of brevity all of the details of those pads will not be reiterated herein. Suffice it to state that as shown in FIG. 2 two such friction enhancing pads, 40 and 42 are shown. Each of these pads is preferably a disposable member formed of a sheet of any suitable material, e.g., paper, having a multitude of abrasive particulates 40A fixedly secured to the outer surface thereof. For example, the sheet may be formed of conventional sand paper or emery paper. In any case the sheet has a releasable pressure sensitive adhesive 40B on the side opposite the gritted side 40A. Other materials can be used to form the sheet, so long as the material is somewhat flexible and suitable for having a releasable pressure sensitive adhesive secured on one side and a plurality of sharp particulates or grit on the opposite side. In order to protect the pressure sensitive adhesive prior to attachment to the device 20 a removable cover sheet 40C is provided.

As can be seen in FIG. 2 the friction enhancing optional pad 40 is of generally X-shape and is arranged to be releasably secured to the outer surface 26A of the attachment device's pad 26 after the cover sheet 40C has been removed. The attachment device's pad 26 includes a peripheral groove of generally X-shape defining the boundary in which the optional friction enhancing pad 40 is to be located and releasably secured. The optional pad 42 is similar to pad 40 in that it includes a gritted surface 42A, an adhesive surface 42B and a removable cover sheet 42C. However, the optional pad 42 is of generally semi-circular shape for releasable mounting on the outer surface of attachment device's heel pad 28.

Figure 5:
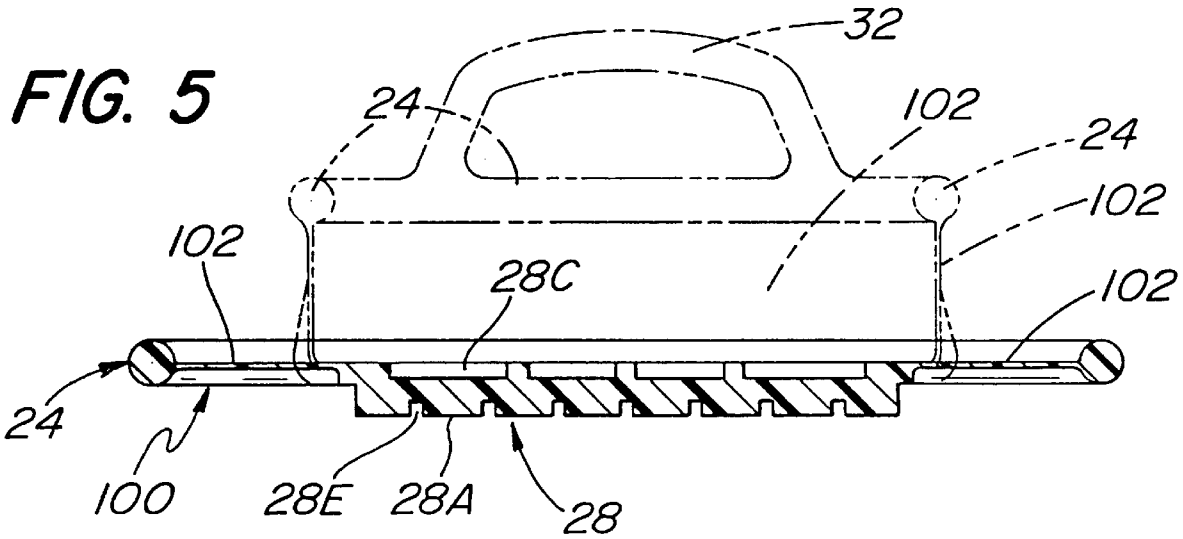
FIG. 5 is view similar to FIG. 3 but showing an alternative embodiment of the attachment device of this invention to provide additional traction and water protection for the primary footwear, with the phantom lines in this figure depicting the peripheral edge portions of the attachment device bent upward in the operative position to secure the attachment device in place on an article of footwear.
Figure 6:
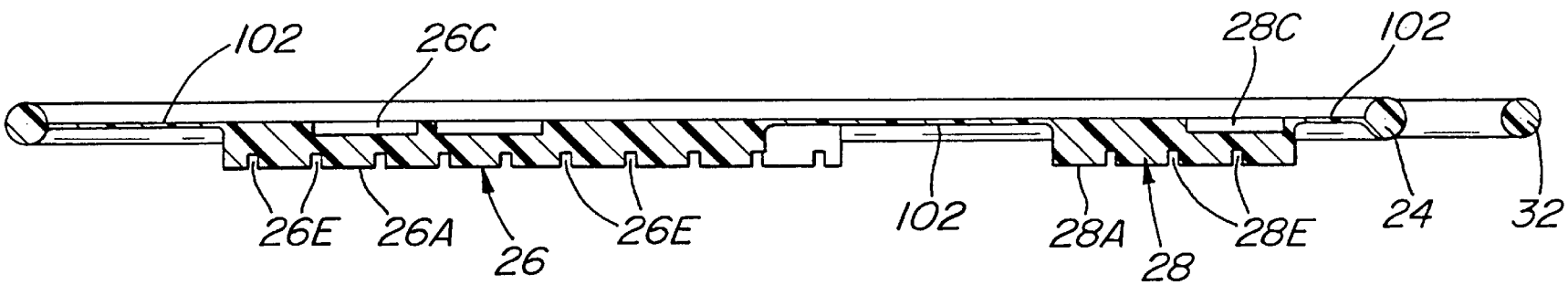
FIG. 6 is a view similar to FIG. 4 but of the embodiment of FIG. 5.

In FIGS. 5 and 6 there is shown an embodiment of an attachment device 100 which is similar in construction to the embodiment of FIGS. 1–4, but in addition provides a moisture barrier to protect the primary footwear from water, slush or other liquids which may be encountered when wearing the attachment device. In the interest of brevity the common features of the attachment device 100 with the attachment device 20 will be given the same reference numbers and the details of their construction and function(s) will not be reiterated. Thus, as can be seen in FIGS. 5 and 6 the attachment device 100 includes the heretofore identified ring 24, pads 26 ad 28, connecting webs 30, and tab 32. In addition, it includes a very thin web or sheet 102 in all of the spaces between the ring 24, the connecting webs 30, the forefoot pad 126 and the heel pad 28. Thus, when the attachment device 100 is in place on the primary footwear, as shown by the phantom lines in FIG. 5, the thin web or sheet 102 in combination with the pads, the connecting web and the ring will provide a fluid impervious barrier to any liquid from the bottom of the primary footwear and along portions of the upper contiguous with the sole and heel up to the location of the ring 24 on that upper.

Figure 7:
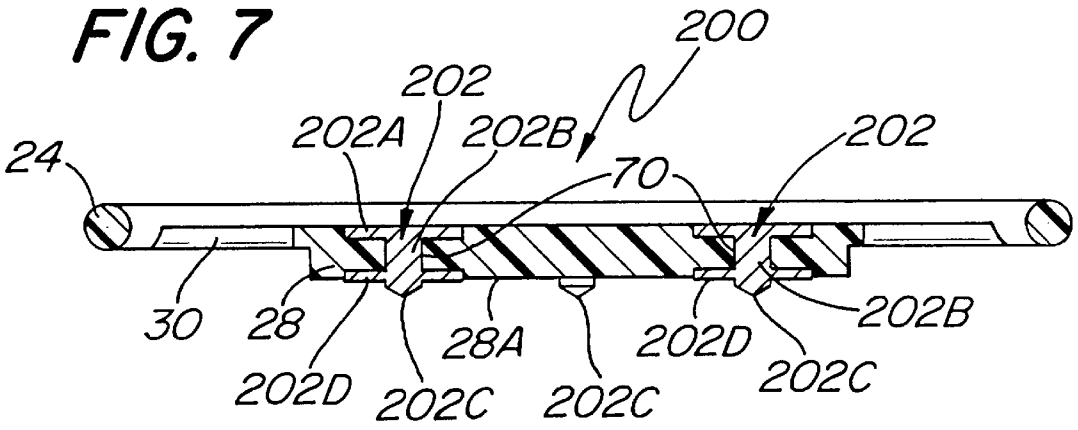
FIG. 7 is a sectional view, similar to FIG. 3, but showing another alternative embodiment of the attachment device of this invention, i.e., an attachment device including plural spikes or cleats suitable for providing resistance to slippage on ice or hardpacked snow.
Figure 8:
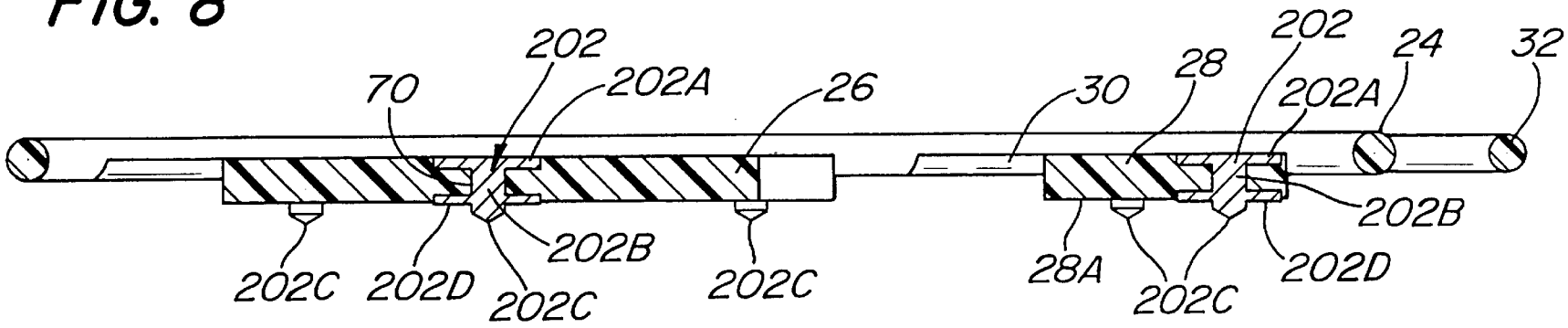
FIG. 8 is a sectional view, similar to FIG. 4, but showing the alternative embodiment of the attachment device of FIG. 7.

In FIGS. 7 and 8 there is shown an embodiment of an attachment device 200 particularly suited for use in very icy conditions. Again the interests of brevity the common features of the attachment device 200 with the attachment device 20 will be given the same reference numbers and the details of the construction and function(s) of those features will not be reiterated. Thus, as can be seen in FIGS. 7 and 8 the pads 26 and 28 each include plural cleats 202. The pads 26 and 28 may include the plural grooves like those described earlier or may include other shaped grooves, or no grooves at all. In any case each of the cleats comprises a hard material, e.g., steel, spike of rivet-like construction. In particular, each cleat includes a disk-like plate 202A from which a central pin or spike 202B projects. The free end 202C of the spike 202B is pointed. A disk 202D is arranged to be connected to the spike slightly to the rear of the pointed free end. Each cleat 202 is arranged to be secured to the associated ground engaging pad of the attachment device 200 by extending the spike through an aperture 70 provided in the pad, e.g., pad 26 or 28, so that the inner plate 202A engages the inside surface of the pad contiguous with the aperture 70, as shown in FIG. 7. The spike is of sufficient length so that its pointed free end 202C extends beyond the outer surface 26A or 28A of the pad in which it is mounted. The disk 202D is disposed on the free end of the spike to sandwich the material making up the pad contiguous with the aperture 70 between the inner plate 202A and the disk 202D. If desired, an annular recess may be provided in the outer surface 26A or 28A of the pad 26 or 28, respectively, contiguous with the aperture 70 to receive the disk 202D therein.

As should be appreciated by those skilled in the art when the attachment device 200 is in place on the primary footwear and the user walks over icy surfaces the pointed free ends of the cleats will dig into the ice to provide very good traction.

In FIGS. 9–11 there is shown an embodiment of an attachment device 300 which is similar in construction to the embodiment of FIGS. 1–4, except for the ground engaging surfaces of the pads 26 and 28. The attachment device 300 is arranged to provide excellent traction in wet conditions, e.g., where there may be water, slush or other liquids which may be encountered on the ground when wearing the attachment device. In the interests of brevity the common features of the attachment device 300 with the attachment device 20 described above will be given the same reference numbers and the details of their construction and function(s) will not be reiterated. Thus, as can be seen in FIGS. 9–11 the attachment device 300 includes the heretofore identified ring 24, pads 26 and 28, connecting webs 30, and tab 32. The outer surface of the pad 26 includes a central longitudinally extending groove 300A which flares in width from the front to the rear of the pad. Flanking the central groove 300A are a pair of grooves 300B and 300C which are mirror images of each other. Each of these grooves is of arcuate shape and flares in width from the front to the rear of the pad. Each of the grooves 300A–300C preferably increases in depth (flares) from front to rear. However, it is contemplated that the grooves 300A–300C be of uniform depth from front to rear, if desired.

A plurality of linear longitudinally extending grooves are located in the area between the groove 300B and the adjacent outer edge of the pad 26 to form plural elongated, longitudinally extending ridges 300D. Similarly a plurality of linear longitudinally extending grooves are located in the area between the groove 300C and the adjacent outer edge of the pad 26 to form plural elongated, longitudinally extending ridges 300E in that area. A plurality of transversely extending grooves are located in the areas between the groove 300B and 300C to form plural elongated, transversely extending ridges 300F.

The outer surface of the pad 28 includes similar features to the pad 26. Thus pad 28 includes a central longitudinally extending groove 300A which flares in width and depth from the front to the rear of the pad. The width of the groove 300A at the front of the pad 28 is just slightly smaller than the width of the groove 300A at the rear of the pad 26, but substantially greater than the width of the groove 300A at the front of the pad 26. Flanking the central groove 300A are a pair of grooves 300B and 300C which are mirror images of each other. Each of these grooves is of arcuate shape and flares in width and depth from the front to the rear of the pad. The width of the grooves 300B and 300C at the front of the pad 28 is just smaller than the width of the grooves 300B and 300C at the rear of the pad 26, but larger than the width of those grooves at the front of the pad 26. A plurality of linear longitudinally extending grooves are located in the area between the groove 300B and the adjacent outer edge of the pad 26 to form plural elongated, longitudinally extending ridges 300D. Similarly a plurality of linear longitudinally extending grooves are located in the area between the groove 300C and the adjacent outer edge of the pad 26 to form plural elongated, longitudinally extending ridges 300E in that area. A plurality of transversely extending grooves are located in the areas between the groove 300B and 300C to form plural elongated, transversely extending ridges 300F.

As should be appreciated by those skilled in the art the shape of the grooves 300A, 300B and 300C, e.g., the flaring of the grooves in width and depth from front to rear, facilitates the ejection of liquid or soft adherent materials therefrom. In particular, these grooves serve to channel or direct any liquid or other soft material, e.g., slush, mud, etc., which may enter the grooves to flow down their length to freely exit the open rear end thereof. Thus, as the user walks any soft material, e.g., snow, slush, mud, etc., which would tend to adhere within the grooves 300A–300C is, instead, forced or ejected out (i.e., is enabled to flow from the narrower and shallower front portion of the grooves into the wider and deeper rear portions of the grooves and out the open end of the grooves).

The longitudinally extending ridges 300D and the transversely extending ridges serve to prevent lateral, particularly outward lateral, and longitudinal sliding of the attachment device over some types of slippery surfaces, e.g., artificial sport surfaces. The transversely extending ridges (and the grooves therebetween) facilitate the flexure of the attachment during normal walking, while providing additional ground-engagement, traction enhancing action.

Figure 12:
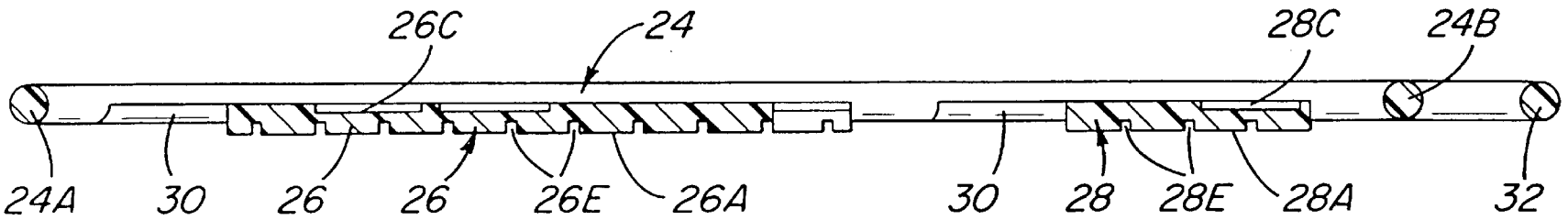
FIG. 12 is a sectional view similar to FIG. 6, but showing yet another alternative embodiment of an attachment device of this invention, e.g., a disposable device for providing enhanced traction.

In FIG. 12 there is shown an alternative embodiment 500 of an attachment device constructed in accordance with this invention. The device 500 is similar to the attachment device 20, except that it is designed to be disposable. Thus, the pads 26 and 28 are made significantly thinner in the device 500 than in the device 20.

Figure 13:
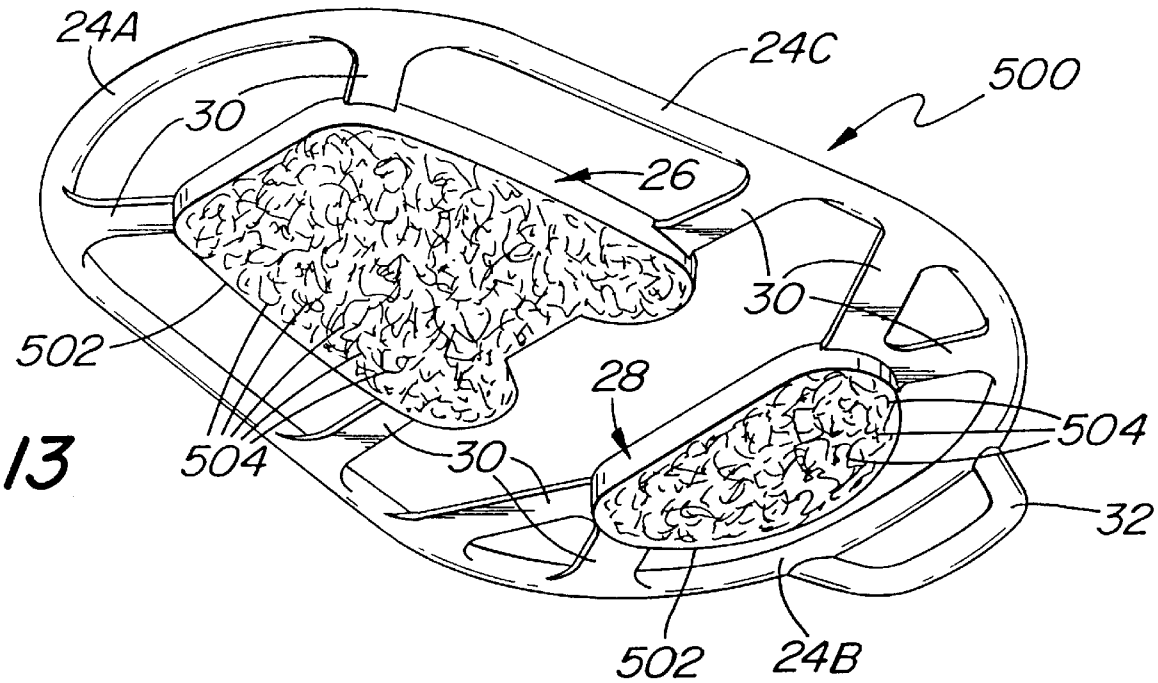
FIG. 13 is a view similar to FIG. 2 but showing still another alternative embodiment of an attachment device of this invention.

In FIG. 13 there is shown another alternative traction-altering, e.g., traction enhancing attachment 500 constructed similarly to the attachment 20 described heretofore. The attachment device 500 is arranged to be mounted on an article of primary footwear which may be worn in slippery indoor applications, to provide resistance to slippage. In the interest of brevity the common features of the attachment device 500 with the attachment device 20 will be given the same reference numbers and the details of their construction and function(s) will not be reiterated. Thus, as can be seen in FIG. 15 the attachment device 500 includes the heretofore identified ring 24, pads 26 and 28, connecting webs 30, and tab 32. However, unlike the embodiment 20 the outer or ground-engaging surfaces of the forefoot-sole portion or pad 26 and the heel-sole portion or pad 28 of the device 500 is in the form of a traction-altering, e.g., friction-enhancing, mat fibrous mats 502.

Each mat 502 is formed of a multitude of fibers 504 which may be organized, e.g., be in the form of loops or tufts, e.g., like carpet, or may be disorganized, e.g., be interlocked or spun or otherwise arranged randomly. The fibers forming the mat may be of any suitable material, e.g., polyester, nylon, or other synthetic fibrous materials. For traction enhancing applications the fibers should be sufficiently hard to prevent slippage, yet not be too hard to damage or abrade common indoor floor surfaces. One particularly suitable material for making the mats of this invention is anti-fatigue traction matting sold by Crown Mats and Matting, a division of Ludlow Composites Corporation of Fremont, Ohio, under the Trademark Diamond Deluxe. That matting comprises a multitude of open loops of vinyl formed into a sheet. The sheets come in various thickness from ⅜ inch to ⅝ inch, and may include a foam backing. These sheets may then but cut to any size and shape to form the mats 502 of the attachment device 500. Mats so constructed have been found to provide sufficient traction to prevent accidental slipping, yet are non-invasive, i.e., will not damage normal indoor floor surfaces. While such non-invasive material mats are desirable to prevent damage to normal indoor floor surfaces, for outdoor application or applications wherein the indoor surface is damage-resistant surfaces, e.g., concrete, the pads 502 may be formed of abrasive fibers, such as interlocked polyester or nylon fibers, such as are used in scouring or floor wax stripping pads, e.g., like the pads disclosed in the aforementioned U.S. Pat. No. 4,924,608 (Mogoyne).

In any case each mat 502 is arranged to be fixedly secured in place on its respective forefoot-sole portion 26 or heel-sole portion 28 by any suitable means, as will be discuss later. Each mat 502 is preferably of the same shape and size as the portion 26 or 28 on which it is mounted, but may be of other sizes or shapes, as desired. One particularly suitable means for securing each mat 502 onto respective forefoot-sole portions 26 and heel-sole portions 28 of the attachment device 500 is an adhesive. That adhesive may be any type suitable for the application, e.g., an adhesive which is brushed or spread on the underside of the mat 502 to the outer side of the portion 26 or 28 onto which it is to be secured, or onto both surfaces. Depending upon its construction, the mat 502 may include a pressure sensitive adhesive layer on its underside to secure it in place. It is also contemplated that the mat 502 may be molded in situ during the fabrication of the attachment device 500 so that it is integral therewith.

As should be appreciated from the foregoing the attachment devices of this invention are simple in construction and can be fabricated readily. Moreover, they are compact so that they can be conveniently stored or transported until ready for use, e.g., a worker can carry the attachments either flat or rolled up in his/her pocket. When it is desired to use the devices, all that is necessary is to stretch the ring and the associated web connectors to place the ring on the upper of the footwear on which the attachment device is to be worn. The pull tab can be used to facilitate the mounting of the attachment device on the footwear. Once in place the device is resistant to displacement on the footwear and offers great stability and resistance to slippage on wet, icy, snowy, muddy or other slippery condition.

Further still, the shape and construction of the ground-engaging pads can be tailored to any particular environment or application to provide increased or decreased traction, as desired.

It should be pointed out at this juncture, that the attachment devices of this invention, when mounted on a primary footwear article, e.g., boot or shoe, are generally resistant to displacement on the footwear. However, for some particularly strenuous activities additional means, e.g., laces, VELCRO® straps, etc. (not shown), may be provided for additional stability. Such straps or laces may be connected to the attachment device at any desirable position, e.g., by means of tabs (not shown), located directly opposite the attachment points of the forefoot pad 26 to the outer ring 24 and/or the attachment points of the heel pad 28 to the outer ring 24.

It should also be pointed out that while it is preferable to mold the attachment devices as an integral unit from a single material (with portions of different thicknesses to provide the desired amount of stretchability in the ring and the connecting webs—and with minimal stretching of the pads), it is contemplated that the attachment devices can be molded of different materials, having different resiliency, hardness, etc., for the various parts of the devices, as desired.

Without further elaboration the foregoing will so fully illustrate our invention that others may, by applying current or future knowledge, adopt the same for use under various conditions of service.

What is claimed is:

1. A footwear attachment device for releasable mounting on a primary footwear to provide a desired type of traction, the primary footwear having an upper including a toe portion, a heel portion and side portions, a sole including a fore-foot portion and a heel portion, said attachment device comprising an integral member having a mounting ring, a forefoot-sole engaging portion, a heel-sole engaging portion and plural stretchable connecting webs, each web being attached at a first end thereof to said mounting ring and having a length extending within the bounds of said ring, said forefoot-sole engaging portion being mounted within the bounds of said ring by attachment to a second end of selected ones of said connecting webs and having a ground engaging fibrous surface, said heel-sole engaging portion being mounted within the bounds of said ring by attachment to a second end of other selected ones of said connecting webs and having a ground engaging fibrous surface, said ring being stretchable to enable said ring to encircle the toe portion, heel portion and side portions of the upper of the primary footwear to releasably mount the attachment device thereon, with said forefoot-sole engaging portion being disposed in engagement with the forefoot portion of the sole of the primary footwear, and with said heel-sole engaging portion being disposed in engagement with the heel portion of the sole of the primary footwear and with said ground engaging fibrous surfaces being exposed for providing a desired type of traction.

2. The attachment device of claim 1 wherein said fibrous surface is formed of a mat of a multitude of organized fibers.

3. The attachment device of claim 1 wherein said fibrous surface is formed of a mat of a multitude of unorganized fibers.

4. The attachment device of claim 1 wherein said fibers are formed of a synthetic material.

5. The attachment device of claim 4 wherein said fibers are formed of vinyl.

6. The attachment device of claim 1 wherein said fibers are vinyl loops.

7. The attachment device of claim 4 wherein said fibers are formed of polyester or nylon fibers.

8. The attachment device of claim 1 wherein said fibrous surfaces are formed of mats having a thickness within the range of ⅜ inch to ⅝ inch.

9. The attachment device of claim 1 wherein said fibrous surface is in the form of a mat having a multitude of vinyl loop fibers.

* * * * *